US012742318B1

(12) United States Patent
Lambert

(10) Patent No.: US 12,742,318 B1
(45) Date of Patent: Sep. 22, 2026

(54) SEPARABLE FAUCET WITH DISTINCT FLOW STREAMS

(71) Applicant: Brandon Lambert, Littleton, CO (US)

(72) Inventor: Brandon Lambert, Littleton, CO (US)

(73) Assignee: Dual Stream Inc., Littleton, CO (US)

( * ) Notice: Subject to any disclaimer, the term of this patent is extended or adjusted under 35 U.S.C. 154(b) by 0 days.

(21) Appl. No.: 19/427,171

(22) Filed: Dec. 19, 2025

Related U.S. Application Data

(60) Provisional application No. 63/933,764, filed on Dec. 8, 2025.

(51) Int. Cl.
*E03C 1/04* (2006.01)

(52) U.S. Cl.
CPC .... *E03C 1/0405* (2013.01); *E03C 2001/0415* (2013.01)

(58) Field of Classification Search
CPC ..... E03C 1/04; E03C 1/0404–0407; E03C 2001/0414–0418; Y10T 137/9464
See application file for complete search history.

(56) References Cited

U.S. PATENT DOCUMENTS

| | | | | |
|---|---|---|---|---|
| 4,975,993 | A | 12/1990 | Black et al. | |
| 6,219,860 | B1 * | 4/2001 | Chang | E03C 1/0404 4/678 |
| 7,552,747 | B1 * | 6/2009 | Sargsyan | E03C 1/0404 4/601 |
| 7,997,513 | B2 | 8/2011 | Chen et al. | |
| 9,573,191 | B2 | 2/2017 | Jagtap et al. | |
| 9,725,891 | B2 * | 8/2017 | Morales | E03C 1/0404 |
| 10,982,418 | B2 * | 4/2021 | Casey | E03C 1/041 |
| 11,261,587 | B2 * | 3/2022 | Rosandich | E03C 1/044 |
| 11,279,610 | B2 * | 3/2022 | Jeon | E03C 1/04 |
| 2013/0056405 | A1 * | 3/2013 | Kawakami | E03C 1/184 210/321.72 |

FOREIGN PATENT DOCUMENTS

| | | | | |
|---|---|---|---|---|
| AU | 2003100927 | A4 | 1/2004 | |
| CN | 102654206 | * | 9/2012 | F16K 11/085 |
| CN | 102654206 | B | 10/2013 | |
| CN | 205963902 | U | 2/2017 | |
| CN | 207886148 | U | 9/2018 | |
| CN | 209229070 | U | 8/2019 | |
| CN | 110645375 | A | 1/2020 | |
| CN | 115076412 | A | 9/2022 | |

(Continued)

*Primary Examiner* — David P Angwin
*Assistant Examiner* — Nicholas A Ros
(74) *Attorney, Agent, or Firm* — Kilpatrick Townsend & Stockton LLP

(57) ABSTRACT

Some embodiments of the present technology may encompass faucets that may include a faucet housing having a first housing member and a second housing member. The first housing member and the second housing member may be pivotable relative to one another about a vertical axis between a joined position in which inner surfaces of the first housing member and the second housing member contact one another and a divided position in which the inner surfaces of the first housing member and the second housing member are spaced apart from one another. The first housing member may define a first water delivery conduit. The second housing member may define a second water delivery conduit.

20 Claims, 10 Drawing Sheets

(56) References Cited

FOREIGN PATENT DOCUMENTS

| | | | | | |
|---|---|---|---|---|---|
| FR | 3151510 | A1 | | 1/2025 | |
| GB | 2316151 | | * | 2/1998 | ..... E03C 1/0404 |
| JP | 2011132757 | A | | 7/2011 | |
| KR | 200191143 | | * | 8/2000 | ..... E03C 2001/0414 |
| KR | 102505861 | B1 | | 3/2023 | |

* cited by examiner

SEPARABLE FAUCET WITH DISTINCT FLOW STREAMS

CROSS-REFERENCE TO RELATED APPLICATIONS

This application claims benefit of U.S. Provisional Patent Application No. 63/933,764, entitled, "SEPARABLE FAUCET WITH DISTINCT FLOW STREAMS", filed Dec. 8, 2025, the contents of which are hereby incorporated by reference in their entirety.

BACKGROUND OF THE INVENTION

Conventional faucet designs typically deliver a single stream of water. While this is suitable for many tasks, there are times when delivering multiple streams of water to a sink would be useful. For example, multiple streams may be desired when two users need to perform independent tasks and/or when a single user wants to perform multiple tasks simultaneously. As just one example, a user may wish to fill a stockpot or other large container while also washing an object. Conventional solutions to these problems have resulted in non-aesthetically pleasing faucet designs and/or faucet setups that require additional plumbing (such as dual faucet layouts), which may incur significant expense. Therefore, improvements in faucet designs that enable delivery of multiple streams of water are desired.

BRIEF SUMMARY OF THE INVENTION

Some embodiments of the present technology may encompass faucets that may include a faucet housing having a first housing member and a second housing member. The first housing member and the second housing member may be pivotable relative to one another about a vertical axis between a joined position in which inner surfaces of the first housing member and the second housing member contact one another and a divided position in which the inner surfaces of the first housing member and the second housing member are spaced apart from one another. The first housing member may define a first water delivery conduit. The second housing member may define a second water delivery conduit.

In some embodiments, the faucets may include a first water hose disposed within the first water delivery conduit. The faucets may include a second water hose disposed within the second water delivery conduit. The faucets may include a spray wand that is movably coupled with the faucet housing. The spray wand may include a first spray wand portion that is coupled with the first water hose and a second spray wand portion that is coupled with the second water hose. The first spray wand portion and the second spray wand portion may be separable from one another. The faucets may include a mixing valve that may be configured to couple each of the first water hose and the second water hose with a hot water supply and a cold water supply. The faucets may include a plurality of mixing valves that may be configured to independently couple the first water hose and the second water hose with a hot water supply and a cold water supply. The faucets may include one or more releasable coupling mechanisms that may be configured to secure the first housing member and the second housing member in the joined position. The one or more releasable coupling mechanisms may include one or both of a magnet and a clasp. The faucets may include a base that may define an aperture through a thickness of the base. The aperture may be sized and shaped to receive lower ends of the first housing member and the second housing member while permitting the first housing member to pivot relative to the second housing member. The base may include a sealing member that seals regions of the aperture not occupied by the first housing member and the second housing member while permitting the first housing member to pivot relative to the second housing member. In the joined position, a width of a seam between the first housing member and the second housing may be less than 0.5 mm. A total travel range between the joined position and a fully divided position may be at least 120 degrees.

Some embodiments of the present technology may encompass faucets that may include a faucet housing having a first housing member and a second housing member. The first housing member and the second housing member may be pivotable relative to one another about a vertical axis between a joined position in which inner surfaces of the first housing member and the second housing member contact one another and a divided position in which the inner surfaces of the first housing member and the second housing member are spaced apart from one another. The first housing member may define a first water delivery conduit. The second housing member may define a second water delivery conduit. The faucets may include a first water hose disposed within the first water delivery conduit. The faucets may include second water hose disposed within the second water delivery conduit. The faucets may include a base that defines an aperture through a thickness of the base. The aperture may be sized and shaped to receive lower ends of the first housing member and the second housing member while permitting the first housing member to pivot relative to the second housing member.

In some embodiments, the faucets may include one or more valve actuators that are configured to control one or both of a flow rate and a temperature of water to the first water hose and the second water hose. The faucets may include a first plurality of magnets spaced along a length of the first housing member. The faucets may include a second plurality of magnets spaced along a length of the second housing member. The first plurality of magnets may be aligned with the second plurality of magnets and may be arranged to attract the second plurality of magnets when the first housing member and the second housing member are proximate one another. When in the joined position, there may be no visible seam between the first housing member and the second housing member. The faucets may include a spray wand that is movably coupled with the faucet housing. The spray wand may include a first spray wand portion that is coupled with the first water hose and a second spray wand portion that is coupled with the second water hose. The first spray wand portion and the second spray wand portion may be separable from one another. The first spray wand portion may include a first plurality of magnets. The second spray wand portion may include a second plurality of magnets. The first plurality of magnets may be aligned with the second plurality of magnets and may be arranged to attract the second plurality of magnets when the first spray wand portion and the second spray wand portion are proximate one another. The faucets may include a spray wand that is movably coupled with the faucet housing. The spray wand may include a first plurality of magnets. A distal end of the faucet housing may include a second plurality of magnets. The first plurality of magnets may be aligned with the second plurality of magnets and may be arranged to attract the second plurality of magnets when the spray wand and the distal end of the faucet housing are proximate one another.

When in the joined position, the first water hose and the second water hose may deliver a single stream of water. Each of the first housing member and the second housing member may form an elongate tube. Each of the first water hose and the second water hose may be independently controllable.

BRIEF DESCRIPTION OF THE DRAWINGS

A further understanding of the nature and advantages of the disclosed technology may be realized by reference to the remaining portions of the specification and the drawings.

Figure 1A:
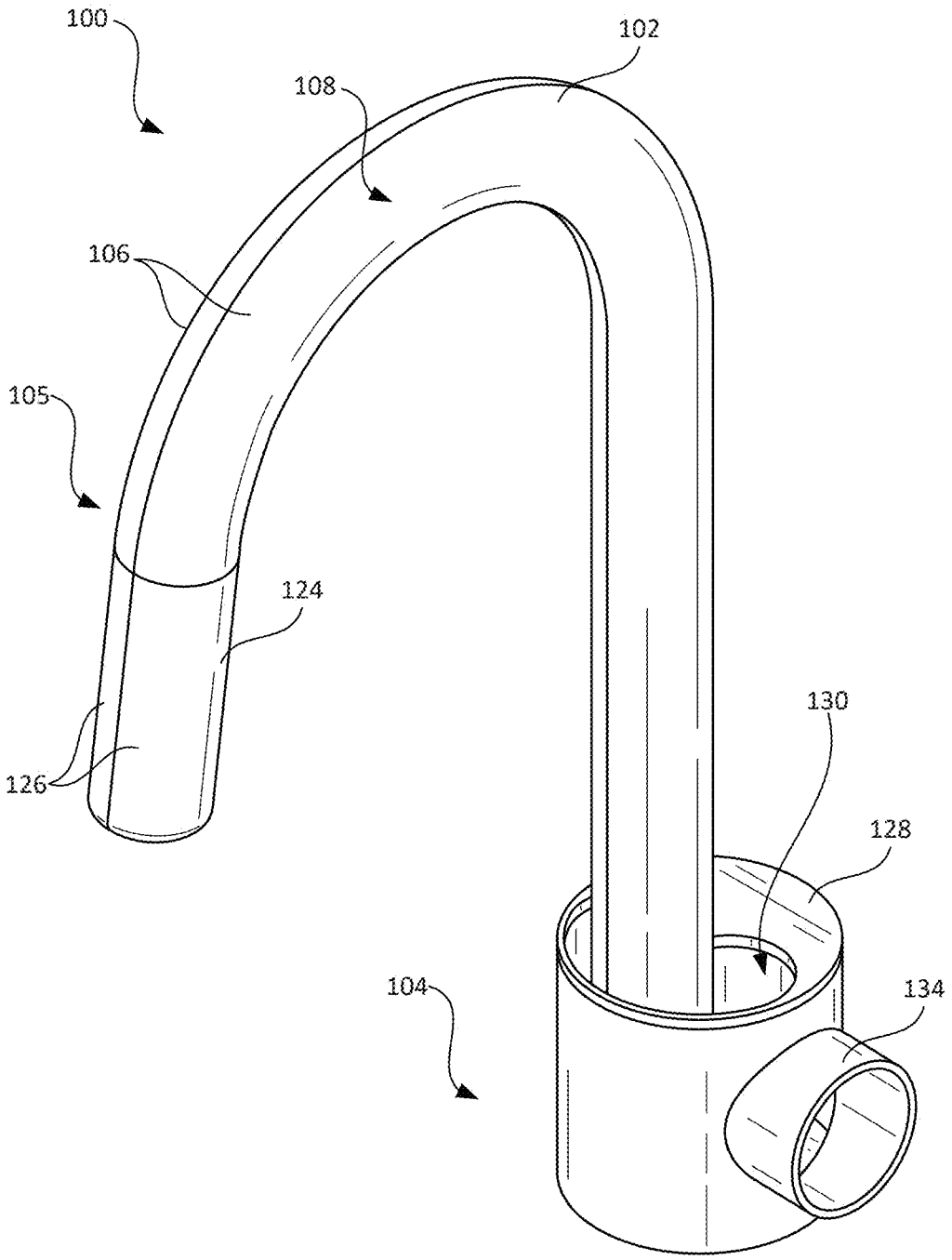
FIG. 1A shows a schematic perspective view of a faucet in a joined position according to some embodiments of the present technology.

Several of the figures are included as schematics. It is to be understood that the figures are for illustrative purposes and are not to be considered of scale unless specifically stated to be of scale. Additionally, as schematics, the figures are provided to aid comprehension and may not include all aspects or information compared to realistic representations and may include exaggerated material for illustrative purposes.

In the appended figures, similar components and/or features may have the same reference label. Further, various components of the same type may be distinguished by following the reference label by a letter that distinguishes among the similar components. If only the first reference label is used in the specification, the description is applicable to any one of the similar components having the same first reference label irrespective of the letter.

DETAILED DESCRIPTION OF THE INVENTION

Embodiments of the present technology encompass faucet designs that enable delivery of multiple independent streams of water. For example, the faucets may include faucet housings that are split along a vertical plane such that the faucet housing includes two housing members, which may each include a separate water line. The housing members may be pivotable relative to one another such that each water line may deliver water to a different location. As just one example, one water line may deliver water to a first side of a sink while another water line may deliver water to a second side of the sink. This may enable the faucet to deliver multiple streams of water that may be used to perform different tasks simultaneously, without the need for an additional faucet. The housing members may be brought into contact with one another and joined to form a unitary faucet that may look and perform like a conventional faucet. In some such embodiments, when joined, the housing members may present a seamless or substantially seamless appearance. Additionally, when joined, some embodiments may generate a single stream of water. One or more coupling mechanisms may be utilized to maintain the housing members in a joined position until a user pivots the housing members relative to one another. In some embodiments, the faucets may include one or more separation members that may assist a user in separating the two housing members. The separation members may be active (e.g., user-actuated via a button or other mechanism) or may be passive and may be engaged by a user releasing a retaining force (e.g., a clasp or latch) and may apply a biasing force that moves the housing members apart from one another. In some embodiments, the faucets may include spray wands that may be drawn from the faucet housing and extended to provide greater control over where the water is delivered. Each housing member may include a dedicated spray wand, with the spray wands being usable as a single spray wand or split into two separate spray wands.

While discussed largely in the context of faucets for kitchen sinks, it will be appreciated that embodiments are not so limited. For example, the faucet designs described herein may be utilized for bar sinks, utility sinks, bathrooms, and/or any other sink applications. Additionally, the techniques described herein may be applicable to any other applications in which the ability to deliver streams of water (or other fluid) to different locations are desired, particularly those in which plumbing costs and/or complexity are a concern and/or in which a clean aesthetic is desired. It will be appreciated that the faucets described herein may be mounted on horizontal, vertical, and/or angled surfaces and are not limited to countertop applications. For example, the faucets may be used as pot fillers, in greenhouses (e.g., for watering plants), and/or other non-kitchen applications that may necessitate vertical and/or other mounting of the faucet. Additionally, while largely described in relation to dispensing water, the faucets described herein may be used to dispense any type of fluid including (but not limited to) greywater, industrial fluids, food-safe liquids, soaps and/or other cleaning solutions, beverages, and/or other fluids.

FIGS. 1A-1G illustrate a faucet 100 according to embodiments of the present technology. The faucet 100 may include a faucet housing 102, which may form the general shape and structure of a portion of the faucet 100 that is visible above a counter or other surface. The faucet housing 102 may have various shapes. For example, as illustrated, the faucet housing 102 has a gooseneck shape, however the faucet 100 may take other forms such as, but not limited to, L-shaped faucets, U-shaped faucets, straight faucets, and/or other ornamental and/or functional designs may be used in various embodiments. The faucet housing 102 may have any cross-sectional shape. For example, the cross-sectional shape of the faucet housing 102 may circular, ovoid, elliptical, rectangular, triangular, and/or other polygon or other cross-sectional shape. The faucet housing 102 may include a proximal inlet end 104 (or lower end) and a distal outlet end 105 (or upper end) through which water (or other fluid) may be delivered. The inlet end 104 may be laterally offset from the outlet end 105, which may enable the outlet end 105 to be positioned over a sink (or other receiving area) while the inlet end 104 is coupled with a countertop and/or other support surface. A distance of the lateral offset between the inlet end 104 and the outlet end 105 may be between 2 inches and 15 inches, between 4 inches and 12 inches, or between 6 inches and 9 inches in some embodiments, although the lateral offset may be outside these ranges based on the needs of a particular application. A maximum height of the faucet housing 102 may be between 3 inches and 18 inches, between 4 inches and 16 inches, between 5 inches and 14 inches, or between 6 inches and 12 inches in some embodiments, although the height may be outside these ranges based on the needs of a particular application.

The faucet housing 102 may include two housing members 106. For example, the faucet housing 102 may be split into the two housing members 106 along a vertical axis and/or vertical plane. This may enable the housing members 106 to be pivotable relative to one another about a vertical axis as will be discussed in greater detail below. While described as a vertical axis or plane, it will be appreciated that the split between the housing members 106 need not be perfectly vertical in some embodiments. For example, an interface between the two housing members 106 may be at an angle relative to vertical (e.g., an angle within 20 degrees of vertical, within 15 degrees of vertical, within 10 degrees of vertical, within 5 degrees of vertical, within 3 degrees of vertical, within 1 degree of vertical, etc.) in some embodiments. Additionally, some embodiments may include an interface between the housing members 106 that includes one or more curved regions, stepped regions, and/or may have other complex shapes. Regardless of the shape of the interface between the housing members 106, the housing members 106 may be moved toward and away from one another relative a central vertical axis or plane, such as an axis or plane that extends through a center (or other position) of the faucet housing 102.

Figure 1B:
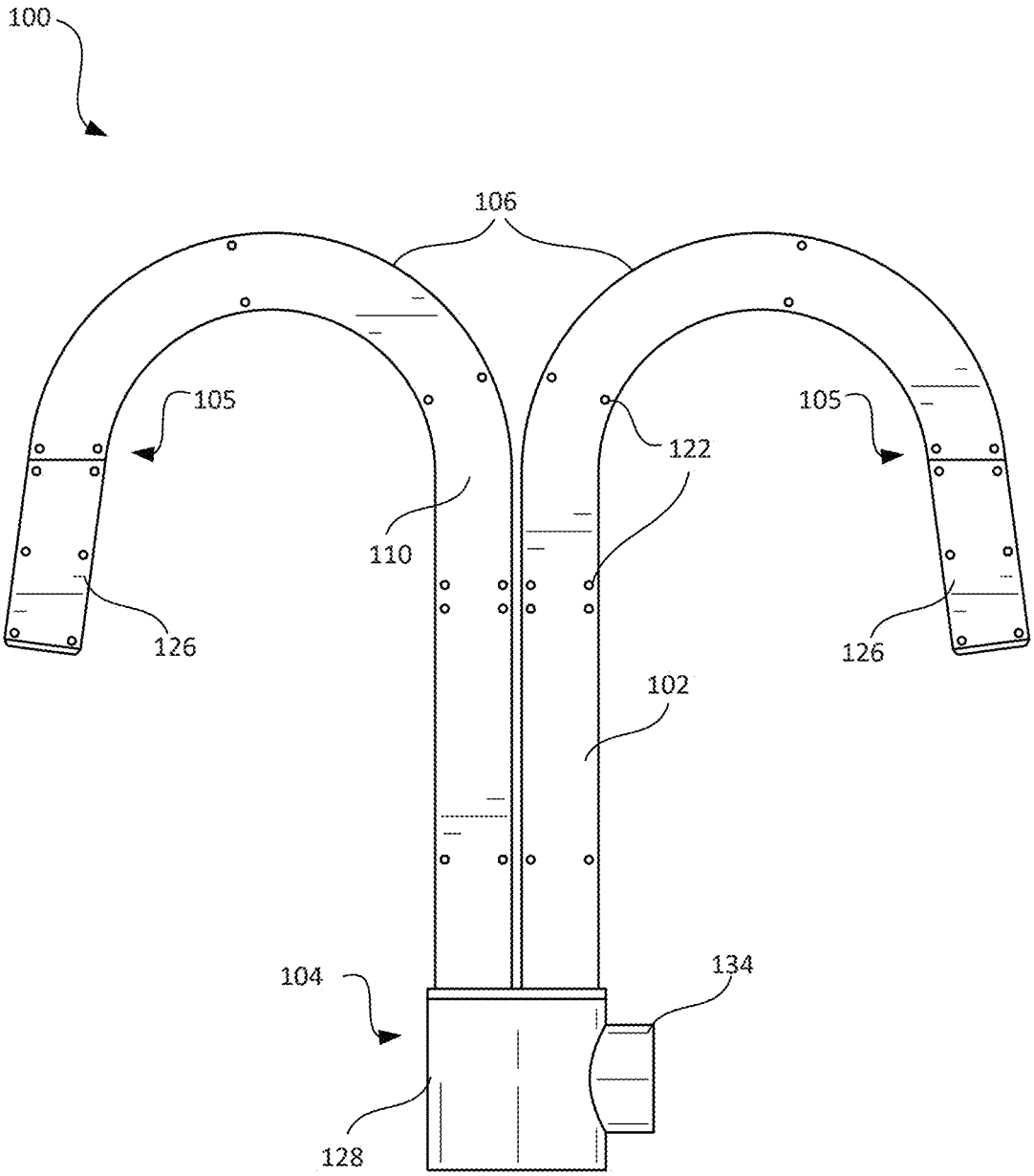
FIG. 1B shows a schematic perspective view of the faucet of FIG. 1A in a divided position according to some embodiments of the present technology.

In the illustrated embodiment, each housing member 106 includes a generally semi-circular cross-section, however other cross-sectional shapes are possible based on the cross-sectional shape of the faucet housing 102. The cross-section may stay constant or substantially constant along of length of each housing member 106 as shown here, while in other embodiments the cross-section of one or both housing members 106 may vary along the length of the respective housing member 106. For example, the shape and/or size of the cross-section may vary along all or part of the length of one or both of the housing members 106 in various embodiments. Each housing member 106 may include an exterior surface 108 that may form a visible exterior surface of the faucet housing 102 when the housing members 106 are in a joined position as illustrated in FIG. 1A. For example, as shown here, the exterior surface 108 is arcuate, although in various embodiments the exterior surface 108 may include any combination of one or more arcuate and/or linear sections. As shown in FIG. 1B, each housing member 106 may include an inner surface 110, with the inner surfaces 110 of each housing member 106 facing one another when in the joined position. In some embodiments, the inner surfaces 110 may be planar as illustrated here, while in other embodiments one or both of the inner surfaces 110 may have one or more non-planar surfaces. For example, the inner surfaces 110 may each include one or more protruding features and/or one or more recessed features. In a particular embodiment, one inner surface 110 may include protruding features while the other includes recessed features. The recessed features may be sized and shaped to receive the protruding features. When in the joined position, the protruding features may be aligned with the recessed features such that each protruding feature is inserted into a corresponding recessed feature. The engagement of the protruding features and the recessed features may help align the two housing members 106 and ensure that, when joined, the housing members 106 produce a unitary appearance. The protruding and/or recessed features may be positioned within a medial region of the inner surface 110 and/or along one or more edges of the inner surface 110. As one example, the longitudinal edges of the inner surface 110 of one housing member 106 may each include a protrusion, while the longitudinal edges of the inner surface 110 of the other housing member 106 may each include a corresponding recessed area. When in the joined position, the edges of the protrusion and the recessed area may contact one another or be in close proximity such that a seam formed between the adjacent longitudinal edges of the housing members 106 has a width of no greater than 1 mm, no greater than 0.75 mm no greater than 0.5 mm, no greater than 0.25 mm, no greater than 0.1 mm, no greater than 0.05 mm, or less to create a seamless or substantially seamless appearance.

Figure 1C:
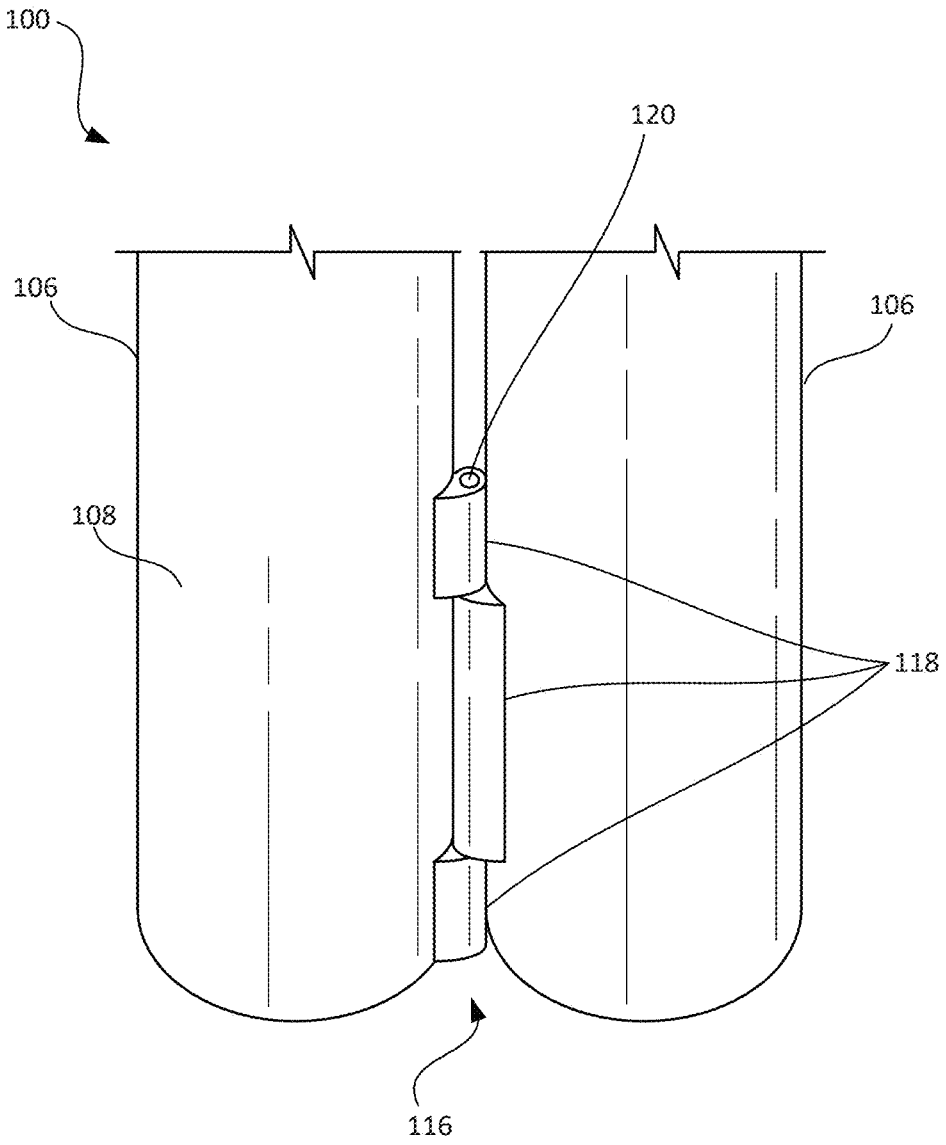
FIG. 1C shows a schematic view of a hinge of the faucet of FIG. 1A according to some embodiments of the present technology.
Figure 1D:
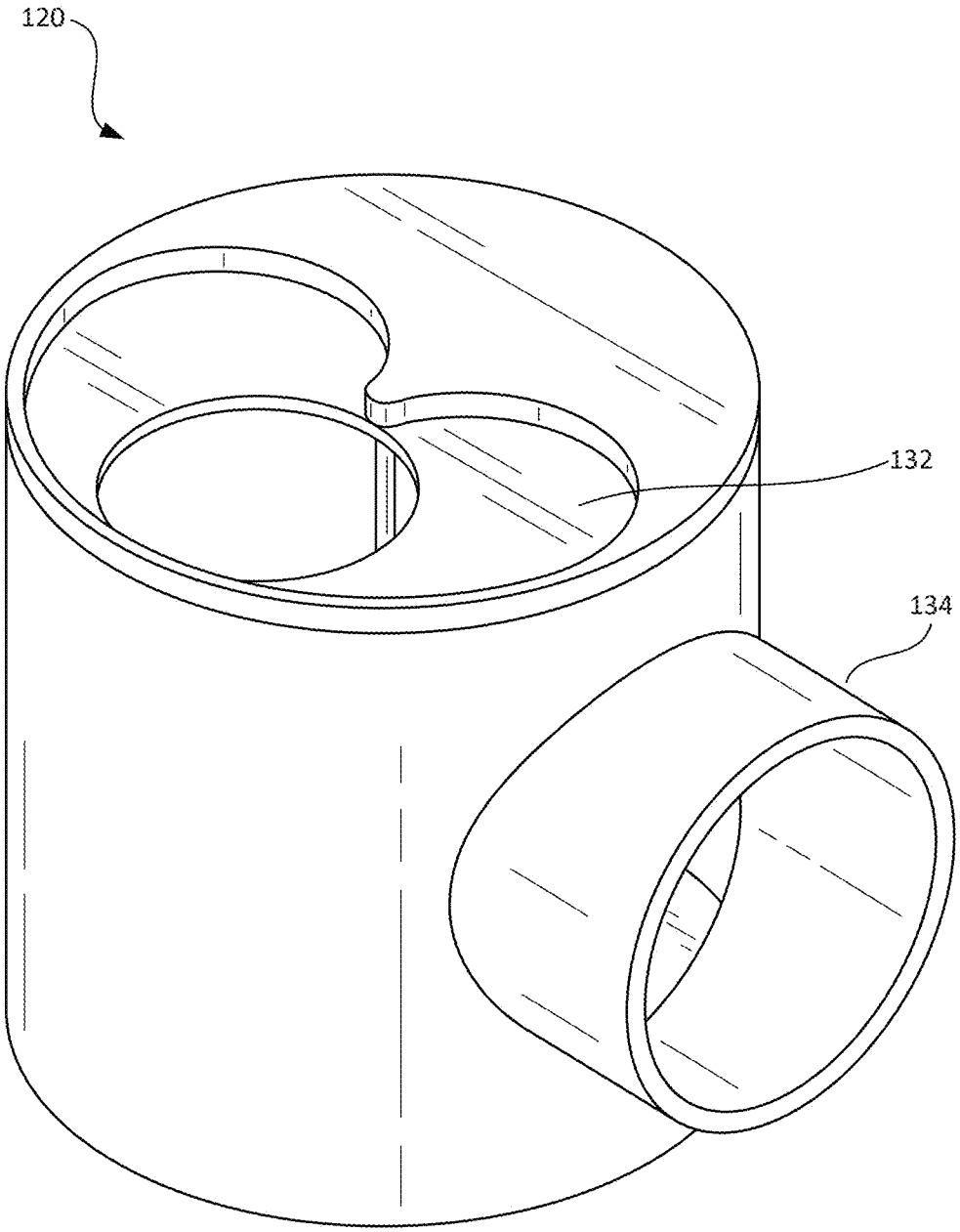
FIG. 1D shows a schematic view of a base of the faucet of FIG. 1A according to some embodiments of the present technology.
Figure 1E:
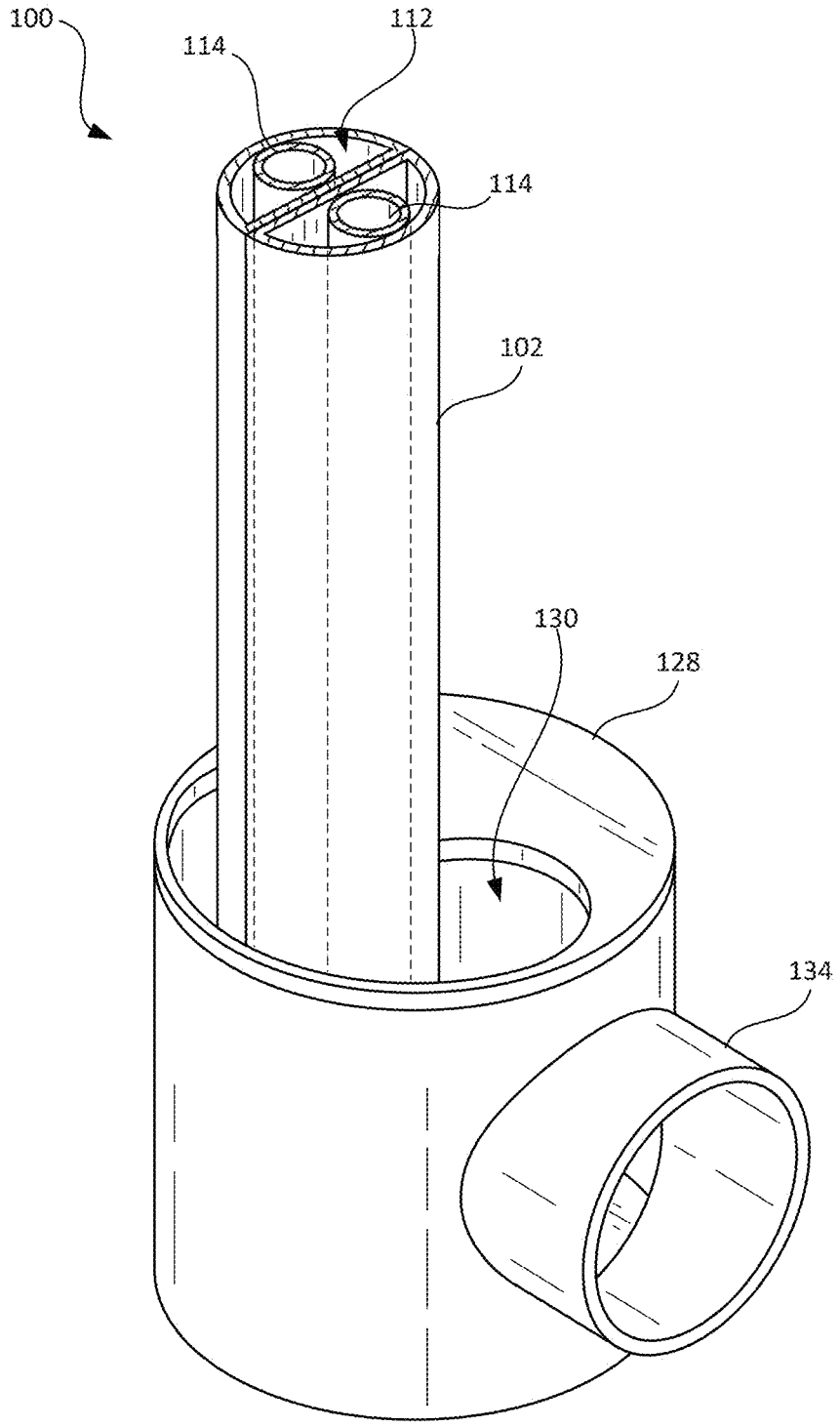
FIG. 1E shows a schematic cross-sectional view of the faucet of FIG. 1A according to some embodiments of the present technology.

Each housing member 106 may be in the form of an elongate tube that may define a water delivery conduit 112 that extends along a length of the respective housing member 106. The water delivery conduit 112 may be formed as an open interior of the housing member 106 and may extend through the inlet end 104 and the outlet end 105. In some embodiments, a cross-sectional shape of each water delivery conduit may be a smaller version of the cross-sectional shape of the respective housing member 106. For example, as illustrated, each water delivery conduit 112 has a semi-circular cross-section that matches the cross-sectional shape of each housing member 106. In other embodiments, the cross-sectional shape of each water delivery conduit 112 may be different than the cross-sectional shape of the respective housing member 106. As just one example, each water delivery conduit 112 may have a circular cross-sectional shape, although other shapes are possible. As best illustrated in FIG. 1E, each water delivery conduit 112 may receive a water hose 114 or other water line that may be coupled with one or more water sources to facilitate delivery of one or more streams of water via the faucet 100. For example, an inlet end of each water hose 114 may be disposed within or extend from the inlet end 104, while an outlet end of each water hose 114 may be disposed proximate the outlet end 105 of the faucet housing 102. An inlet of each water hose 114 may be coupled with one or more water sources, such as a hot water supply and/or a cold water supply. The inlet may be directly or indirectly coupled with the water sources. For example, a mixing valve may be disposed between the inlet and the water sources and may be configured to control a mixture of hot and cold water to modulate a temperature of water delivered to the inlet of each water hose 114. An outlet of each water hose 114 may be disposed proximate the outlet end 105 of the faucet housing 102 and/or at an outlet end of a spray wand 124. In some embodiments, the outlet of each water hose 114 may include or be coupled with a nozzle and/or aerator that may modulate the flow of water dispensed from the faucet 100. The water hoses 114 may enable water to be flowed through each housing member 106 without the water coming into contact with the housing member 106 itself. The water hoses 114 may be fixed within the water delivery conduits 112 in some embodiments. In other embodiments, the water hoses 114 may be longitudinally slidably disposed within each water delivery conduit 112, which may enable the inclusion of a spray wand 124.

In some embodiments, each housing member 106 may be symmetrical, with each housing member 106 making up 50% of the faucet housing 102. In other embodiments, the housing members 106 may be asymmetric. The asymmetry may be noticeable, such as where each housing member 106 has a notably different size and/or shape. In other embodiments, the asymmetry may be minor, such as by having a slightly different geometry on the inner surface 110 and/or edges thereof (e.g., via the presence of protruding and/or recessed features) to promote the joining of the housing members 106 in the joined position. Typically, each housing member 106 may form between 40% and 60%, between 45% and 55%, or about 50% of the cross-sectional area of the faucet housing 102, although other variations are possible. For example, one of the housing members 106 may form approximately 40% of the cross-sectional area of the faucet housing 102, while the other housing member 106 may form approximately 60% of the cross-sectional area of the faucet housing 102, with the two housing members 106 often forming all or substantially all of the faucet housing 102.

As noted above, the housing members 106 may be pivotable relative to one another about a vertical axis. For example, the housing members 106 may be pivoted or otherwise moved between a joined position in which inner surfaces 110 (e.g., longitudinal edges of the inner surfaces 110) of each housing member 106 contact one another (as shown in FIG. 1A) and a divided position in which at least a portion of the inner surfaces 110 of each housing member 106 are spaced apart from one another (as shown in FIG. 1B). In the joined position, the inner surfaces 110 of each housing member 106 may face one another. In some embodiments, the inner surfaces 110 may be parallel with one another, however other designs are possible. The inner surfaces 110 may be in contact with one another or may be spaced apart from one another in the joined position. Longitudinal edges of each inner surface 110 and/or exterior surfaces 108 of the housing members 106 may be in close proximity with one another when in the joined position. For example, the longitudinal edges of each inner surface 110 and/or exterior surfaces 108 of the housing members 106 may be within 1 mm, within 0.75 mm within 0.5 mm, within 0.25 mm, within 0.1 mm, within 0.05 mm, or less of one another, which may create a seamless or substantially seamless aesthetic when the housing members 106 are in the joined position. In some embodiments, the longitudinal edges may contact one another. In some such embodiments, the machining (or other production) tolerances of the housing members 106 may be sufficiently precise that there is no visible seam between the housing members 106 when in the joined position. In some embodiments, alignment features (such as corresponding protruding and recessed features) may be used to help align the housing members 106 to ensure that the exterior surfaces 108 are perfectly aligned to ensure a seamless appearance. In some embodiments, the water hoses 114 of each housing member 106 may be in sufficiently close proximity when in the joined position that water streams from each water hose 114 join to form a single stream of water upon being dispensed from the faucet 100. In other embodiments, the water hoses 114 may be sufficiently separated in the joined position such that the faucet 100 delivers two distinct water streams, which may be parallel in some instances.

In the divided position, at least a portion (e.g., a front longitudinal edge and a portion of the inner surfaces 110) of the housing members 106 may be laterally spaced apart from one another as shown in FIG. 1B. For example, the two housing members 106 may be pivoted, rotated, or otherwise moved relative to one another about one or more vertical axes to splits the faucet housing 102 into two distinct portions, thereby enabling two distinct streams of water to be dispensed to different locations, such as to different containers and/or different regions of a sink or other receptacle. In some embodiments, rear longitudinal edges of the housing members 106 may remain in contact with one another during the pivoting motion, while in other embodiments the rear longitudinal edges of the housing members 106 may separate from one another when in the divided position. In some embodiments, a total travel range between the joined position and a fully divided position may be at least 120 degrees, at least 130 degrees, at least 140 degrees, at least 150 degrees, at least 160 degrees, at least 170 degrees, at least 180 degrees, or more. In other words, the front longitudinal edges of the housing members 106 may be separated by between 120 degrees and 200 degrees, between 140 degrees and 190 degrees, or between 160 degrees and 180 degrees when fully divided in some embodiments. However, during use, the housing members 106 may be divided by any intermediate angle between 0 degrees and the fully divided travel range to meet the needs of a particular user. For example, one or both of the housing members 106 may be pivoted relative to a center position to a maximum counterclockwise or clockwise position and any intermediate position therebetween.

In some instances, a divided position may include one housing member 106 at a center position and the other housing member 106 pivoted clockwise or counterclockwise relative to the center position, either along part or all of a maximum travel range of the housing member 106. In other instances, both of the housing members 106 may be pivoted clockwise or counterclockwise relative to the center position. In some such instances, the housing members 106 may be on opposite sides of the center position, while in other instances the housing members 106 may be on a same size of the center position. In some embodiments, the housing members 106 may be pivoted together (e.g., in the joined position) in a clockwise or counterclockwise relative to the center position. This may enable the housing members 106 to be moved relative to the sink or other receptacle even when in the joined position.

In some embodiments, the faucet housing 102 may include a hinge 116 that may be used to pivotably couple the housing members 106 and to constrain relative movement of the housing members 106 about a pivot axis (e.g., an axis of the hinge 116). As best illustrated in FIG. 1C, the hinge 116 may be formed proximate the inlet end 104 of the faucet housing 102. For example, each housing member 106 may include a sleeve 118 that protrudes from or is otherwise formed proximate a lower end of the rear longitudinal edge of the housing members 106. The sleeves 118 of each housing member 106 may be vertically offset such that central axes of the sleeves 118 may be aligned along a vertical axis. A pin 120 or other pivot member may be positioned within a central aperture formed within each sleeve 118 to align and pivotally couple the two housing members 106 together. It will be appreciated that the hinge 116 described above is merely provided as one example and that various hinge designs may be utilized in different embodiments. Additionally, some embodiments may incorporate multiple hinges, which may operate in tandem or independently. For example, in some instances, multiple hinges may be used to couple the two housing members 106 and may be disposed at different locations along a length of the housing members 106. In other embodiments, each housing member 106 may include one or more dedicated hinges that facilitate pivoting of only a single one of the housing members 106.

In some embodiments, rather than (or in addition to) a hinge, the faucet housing 102 may utilize other features to constrain the movement of the housing members 106. For example, each housing member 106 may be engaged with a track, which may be a separate component, such as an arcuate track formed on a base 128 or other component of the faucet 100. The track may define and constrain the movement of one or both housing members 106 to a given movement path and/or range of motion. In some such embodiments, each housing member 106 may include a roller, guide, and/or other feature that may be engaged with the track to facilitate rotational movement of the housing member 106 about the track. In other embodiments, lower ends of each housing member 106 may include a track that may be engaged with a roller, guide, or other feature of another component.

While described primarily as being pivotable relative to one another, it will be appreciated that in some embodiments the housing members 106 may move in other ways between the joined position and the divided position. For example, the housing members 106 may slide, telescope, articulate, and/or otherwise move relative to one another. Additionally, the movement path may be linear, arcuate, combinations of linear and/or arcuate paths, and/or any other travel path that enables the housing members 106 to move toward and away from one another.

In some embodiments, the faucet 100 may include one or more releasable coupling mechanisms that may be configured to secure the housing members 106 together in the joined position for normal use (e.g., as a single position faucet). The coupling mechanisms may include clasps, latches, snaps, magnets, and/or other devices that may be used to selectively maintain the faucet housing 102 in the joined position. For example, as best illustrated in FIG. 1B, the inner surface 110 of each housing member 106 may include a number of magnets 122 that are positioned along a length of the housing member 106. Each housing member 106 may include one or more magnets, two or more magnets, three or more magnets, four or more magnets, five or more magnets, six or more magnets, or more. The magnets 122 may be arranged at regular or irregular intervals along the length of each housing member 106, with the magnets 122 of one housing member 106 being aligned with the magnets 122 of the other housing member 106 when in the joined position. The magnets 122 of each housing member 106 may be arranged to attract the magnets 122 of the opposing housing member 106 when the housing members 106 are proximate one another (e.g., within 20 degrees, within 15 degrees, within 10 degrees, within 5 degrees, within 3 degrees, within 1 degree, or less). For example, corresponding aligned pairs of magnets 122 on the housing members 106 may be oriented such that opposing poles of the magnets 122 face one another when the housing members 106 are positioned in the joined position. Such a design may enable the magnets 122 to secure the housing members 106 in the joined position until a user (and/or component of the faucet 100) applies sufficient force to overcome the collective force of the magnets 122 to manipulate the faucet housing 102 into the divided position.

In some embodiments, a user may apply force directly to one or both of the housing members 106 to manipulate the housing members 106 from the joined position to the divided position. For example, a user may grasp one or both housing members 106 and apply lateral force to pivot one or both of the housing members 106 relative to one another. In some embodiments, the faucet 100 may include one or more separation members that may help a user manipulate the faucet housing 102 from the joined position to the divided position. The separation members may include spring-loaded members, cams, and/or other mechanisms that may be selectively actuated to push the housing members 106 apart. For example, each separation member may include a component that is designed to press against the inner surface 110 and/or front longitudinal edge of one or both of the housing members 106 when actuated, such as via a button or other control feature. In some embodiments, such as those in which the coupling mechanisms include clasps and/or latches, the separation members may include springs, magnets that repel one another, and/or other passive biasing members. When the clasp or latch is engaged, the clasp or latch may supply sufficient closing force to overcome the spring force (or other biasing force) and may maintain the faucet housing 102 in the joined position. When the clasp or latch is disengaged, the spring force may be sufficiently high so as to press the housing members 106 away from one another. It will be appreciated that other separation mechanisms may be used in various embodiments.

In some embodiments, the outlet end 105 of the faucet housing 102 may form the dispensing outlet of the faucet 100 (e.g., there is no spray wand present). In other embodiments, the faucet 100 may include a spray wand 124 that is coupled with the outlet end 105 of the faucet housing 102. For example, a proximal end of the spray wand 124 may be sized and shaped to couple (possibly seamlessly) with the outlet end 105 of the faucet housing 106, while a distal end of the spray wand 124 may serve as the dispensing outlet of the faucet 100. For example, each water hose 114 may extend beyond the outlet end 105 and may extend into an interior of the spray wand 124, with an outlet of the water hose 114 may be coupled such that the water is delivered through the distal end of the spray wand 124. The spray wand 124 may be movably coupled with the faucet housing 102. For example, the spray wand 124 may be extendible from the faucet housing 102, such as to spray or otherwise dispense water to areas not accessible via the fixed faucet housing 102. For example, a user may pull the spray wand 124 away from the faucet housing 102, which may cause the water hoses 114 to be drawn through the water delivery conduits 112, leaving a portion of the water hose(s) 114 exposed between the spray wand 124 and the outlet end 105 of the faucet housing 102. When spraying is complete, the spray wand 124 may be pressed toward and/or otherwise retracted against the faucet housing 102. To aid in the retraction process, as well as to ensure that in a neutral position the spray wand 124 is interfaced with the outlet end 105 of the faucet housing 102, each water hose 114 may include a counterweight that is positioned below the faucet housing 102. Each counterweight may help bias the water hose 114 and the spray wand 124 toward the outlet end 105 of the faucet housing 102. In some embodiments, to help keep the spray wand 124 positioned against the outlet end 105 of the faucet housing 102 when the spray wand 124 is not being extended, the spray wand 124 and the distal end of each housing member 106 may include one or more magnets (not shown). The magnets of the spray wand 124 may be aligned with and arranged to attract the magnets of the outlet end 105 of the faucet housing 102 when the spray wand 124 and the outlet end 105 of the faucet housing 102 are proximate one another. The collective force of the magnets may be selected to match or exceed a weight of the spray wand 124 and/or water hoses 114 in some embodiments. It will be appreciated that other mechanisms may be used in addition to, or in place of, the counterweights and/or magnets in various embodiments to assist in the retraction and/or retention of the spray wand 124 against the outlet end 105 of the faucet housing 102.

The spray wand 124 may include two spray wand portions 126, which may correspond with the two housing members 106. For example, the spray wand 124 may be divided into two halves (or other sized portions) that may be split along a same vertical plane as the faucet housing 102. One spray wand portion 126 may couple with one of the housing members 106 and one of the water hoses 114 while the other spray wand portion 126 may couple with the other housing members 106 and the other water hose 114. The two spray wand portions 126 may be separable from one another to enable the spray wand portions 126 to be used independently or as a single unit as will be discussed in greater detail below. The spray wand portions 126 may be formed in a similar manner as the housing members 106, which may enable the spray wand portions 126 to be joined to create a seamless or substantially seamless aesthetic when joined in some embodiments.

In some embodiments, the spray wand 124 may include one or more releasable coupling mechanisms that may be configured to secure the spray wand portions 126 together. The coupling mechanisms may include clasps, latches, snaps, magnets, and/or other devices that may be used to selectively maintain the spray wand 124 in a joined position. For example, an inner surface of each spray wand portion 126 may include a number of magnets that are positioned along a length of the spray wand portion 126. The magnets of each spray wand portion 126 may be arranged to attract the magnets of the opposing spray wand portion 126 when the spray wand portions 126 are proximate one another. In some embodiments, a user may apply force directly to one or both of the spray wand portions 126 to manipulate the spray wand portions 126 away from one another. In some embodiments, the spray wand 124 may include one or more separation members that may help a user manipulate the spray wand portions 126 to move apart.

Figure 1F:
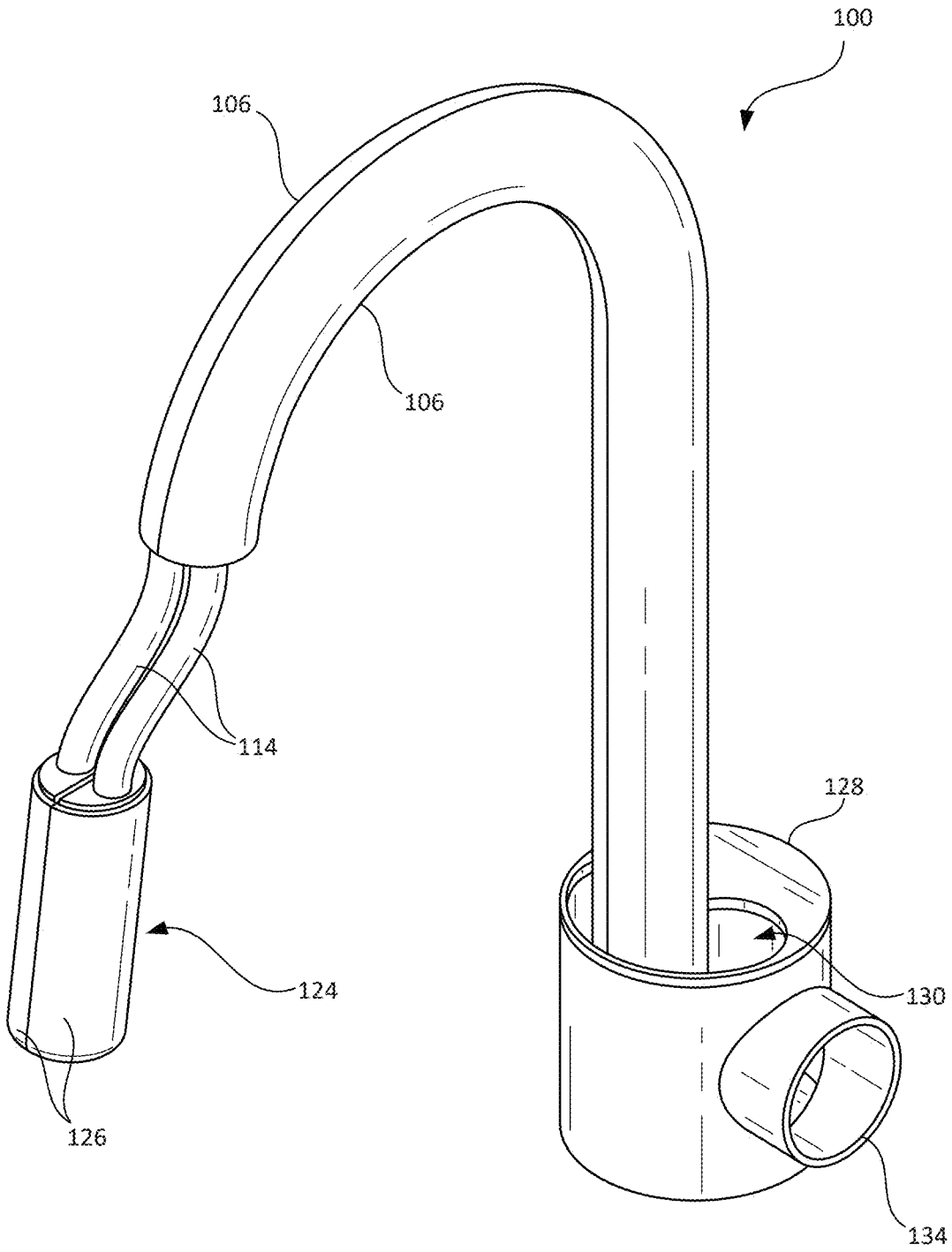
FIG. 1F shows a schematic perspective view of the faucet of FIG. 1A with a spray wand extended according to some embodiments of the present technology.
Figure 1G:
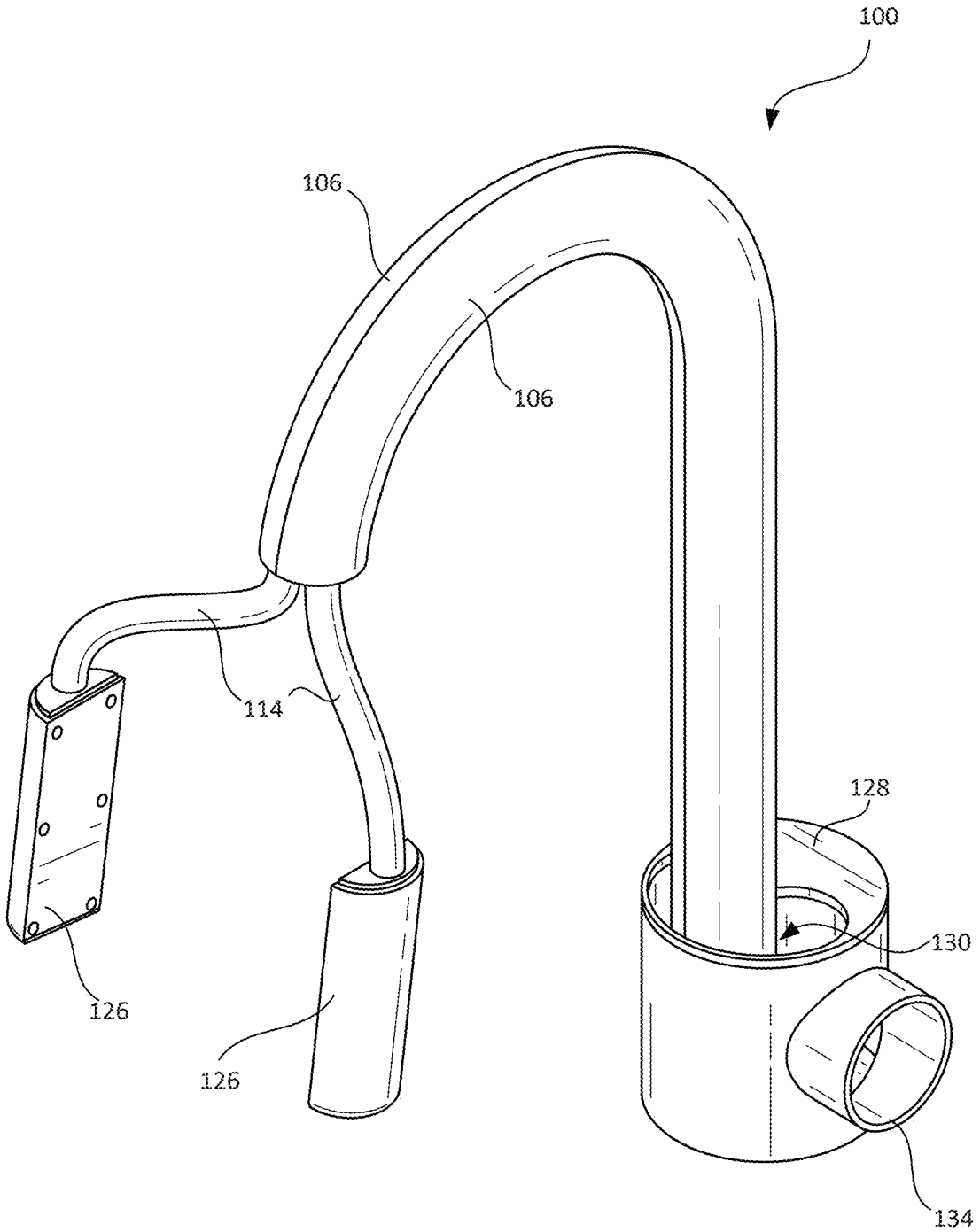
FIG. 1G shows a schematic perspective view of the faucet of FIG. 1A with a spray wand extended and separated into two spray wand portions while the faucet housing is in a joined position according to some embodiments of the present technology.
Figure 1H:
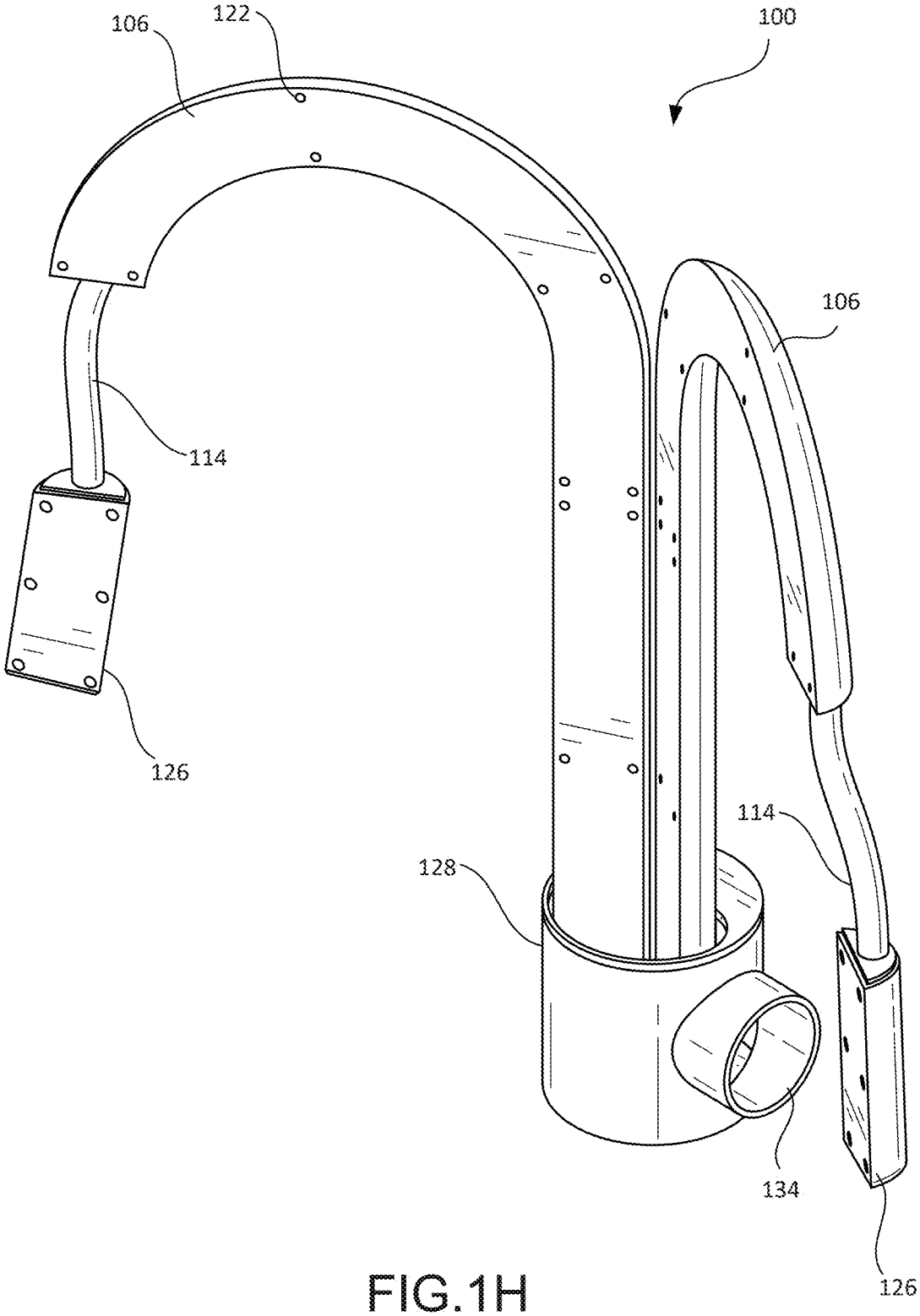
FIG. 1H shows a schematic perspective view of the faucet of FIG. 1A with a spray wand extended and separated into two spray wand portions while the faucet housing is in a divided position according to some embodiments of the present technology.

The spray wand 124 may be used as a single unitary spray wand 124 as shown in FIG. 1F, which may deliver a single stream of water in some embodiments. For example, both spray wand portions 126 may be pulled away and extended from the faucet housing 102 as a single unit. In some such instances, the spray wand portions 126 may be held together via the coupling mechanisms and/or by the user's hand. In other embodiments, one or both of the spray wand portions 126 may be pulled away and extended from the faucet housing 102 independently, thus enabling a user to use one or both spray wand portions 126 to deliver water to different locations for different tasks simultaneously. For example, one or both of the spray wand portions 126 may be extended from the faucet housing 102 and separated from one another while the faucet housing 102 is in the joined position (as shown in FIG. 1G) or while the faucet housing 102 is in a divided position (as shown in FIG. 1H). In such instances, the spray wand portions 126 may be separated from one another in a manner similar to the housing members 106 such that relative heights, angles, and/or lateral positions of the spray wand portions 126 may be varied relative to one another to meet the needs of a particular situation. For example, any coupling mechanisms may be disengaged and the spray wand portions 126 may be separated from one another. The separability of the two spray wand portions 126 may also facilitate the split operation of the housing members 106 when the faucet 100 is used in the divided position with the spray wand 124 retracted against the faucet housing 102. For example, when the housing members 106 are pivoted away from one another, the spray wand portions 126 may also be pivoted away from one another. When the housing members 106 are brought back together, the spray wand portions 126 may also be brought back together.

In some embodiments, the spray wand 124 may include one or more nozzles and/or nozzle settings that may enable the spray characteristics (e.g., spray pattern and/or pressure) of water dispensed from the spray wand 124 (or faucet 100) to be adjusted. For example, the spray wand 124 may deliver a single stream of water, a number of jetted streams of water, a number of pulses of water, and/or other flow pattern of water. In such embodiments, the spray wand 124 may include one or more buttons, switches, dials, and/or other adjustment mechanisms that enable the spray pattern and/or pressure to be adjusted. In some embodiments, the spray wand 124 may include a single adjustment mechanism that controls the spray characteristics for the whole spray wand 124. In some embodiments, each spray wand portion 126 may include a dedicated adjustment mechanism, which may enable the spray characteristics of water dispensed from each spray wand portion 126 to be controlled independently.

The faucet 100 may include a base 128, which may be used to couple the faucet housing 102 with a counter or other support surface on which the faucet 100 is mounted, as well as to constrain movement of the housing members 106. The base 128 may be a generally hollow component that has a greater cross-sectional area than the inlet end 104 of the faucet housing 102. The base 128 may house various components of the faucet 100, guide movement of the faucet housing 102, and/or facilitate coupling of the faucet 100 with a counter or other support surface. In some embodiments, the base 128 may be sufficiently tall so as to receive the hinge 116, which may enable the faucet 100 to have a cleaner aesthetic. As illustrated, the base 128 has a generally cylindrical shape, however any cross-sectional shape is possible in various embodiments. The base 128 may define an aperture 130 through a thickness of the base 128. The aperture 130 may be sized and shaped to receive lower ends of each housing member 106 while permitting the housing members 106 to pivot relative to one another. For example, as best illustrated in FIG. 1D, the aperture 130 may be kidney bean shaped, although other arcuate, annular, circular, and/or other shaped apertures may be used in various embodiments. The aperture 130 may be sized to permit the full travel range of the housing members 106. For example, the aperture 130 may be sized to permit the housing members 106 to pivot along a path of between 120 degrees and 200 degrees (as well as any intermediate position) in some embodiments. In some embodiments, the aperture 130 may form all or a portion of a track or guide that is used to limit movement of one or both of the housing members 106 to a predefined travel path.

The base 128 may include one or more gaskets and/or other sealing members 132 that may be used to seal portions of the aperture 130 that are exposed about the housing members 106 while permitting the housing members to pivot relative to one another. The sealing members 132 may be disposed against the exterior surfaces 108 of the housing members 106 and/or between the opposing inner surfaces 108 of the housing members 106. The sealing members 132 may be formed from a compressible and/or movable material that enables the housing members 106 to be moved within the aperture 130 while still sealing the gaps between the housing members 106 and the base 128. In some embodiments, the sealing members 132 may include highly compressible polymeric materials. In some embodiments, one or more of the sealing members 132 may include a mechanical iris diaphragm (e.g., similar to those used in camera lenses), which may include a number of overlapping blades that may open and close to seal portions of the aperture 130 that are not occupied by the housing members 106 as the housing members 106 are pivoted within the aperture 130. In some embodiments, the sealing members 132 may include retractable blades or panels that may be positioned against lower ends of the exterior surfaces 108 of the housing members 106. Each blade may seal or cover a region of the aperture 130 that is disposed laterally outward of the housing member 106. Each housing member 106 may be coupled with a respective blade such that when the housing member 106 is moved within the aperture 130, the blade moves in a corresponding arcuate path. For example, when the housing member 106 is moved within the aperture 130 in a first direction, the housing member 106 may push the connected blade in the first direction. When the housing member 106 is moved within the aperture 130 in a second direction, the housing member 106 may pull the connected blade in the second direction. Each blade may be designed to seal the region of the aperture 130 that is disposed laterally outward of the housing member 106. For example, the blade may be or include a material that contacts the base 128 and seals the interfaces between the blade, the base 128, and the exterior surface 108 of the housing member 106. In some embodiments, an additional sealing member 132 may be disposed between the inner surfaces 110 of the housing members 106 to seal the area between the housing members 106 when in the divided position. Other sealing members are possible in various embodiments.

The base 128 may include and/or be coupled with one or more valve actuators 134 that are configured to control one or both of a flow rate and a temperature of water to each water hose 114. For example, each valve actuator 134 may be coupled with one or more valves disposed below the base 128 that are interfaced with the water hoses 114. While shown as a knob extending from a lateral surface of the base 128, the valve actuators 134 may take various forms. For example, the valve actuators 134 may include handles, knobs, levers, joysticks, push buttons, hands free sensors, and/or other mechanisms, which may be coupled with one or more surfaces (e.g., lateral and/or top) of the base 128, the faucet housing 102, and/or positioned remotely from the base 128 and/or the faucet housing 102. In some embodiments, a single valve actuator 134 (or single set of valve actuators 134) may be used to control the flow (e.g., flow rate, temperature, etc.) of water to both of the water hoses 114 simultaneously, while in other embodiments, each water hose 114 may be independently controllable, such as by being coupled with one or more dedicated valve actuators 134. For example, a first valve actuator 134 (or set of valve actuators) may be coupled with a first housing member 106 while a second valve actuator 134 (or set of valve actuators) may be coupled with a second housing member 106. Such a configuration may enable the water hoses 114 to deliver different temperatures and/or flow rates of water, including the ability to operate only a single water hose 114 while the other dispenses no water. This may enable the flow of water through each housing member 106 and/or spray wand portion 126 to be independently controlled, which may allow users to use one set of flow characteristics (e.g., high flow rate hot water) through one portion of the faucet 100 while a different set of flow characteristics (e.g., low flow rate cold water) is dispensed through the other portion of the faucet 100. In some such embodiments, an additional valve actuator 134 (or set of valve actuators) may be provided that controls the flow through both water hoses 114 simultaneously. This may enable a single user to dispense water with a single set of flow characteristics through both water hoses 114 (either in faucet mode or spray wand mode) with a single set of valve controls.

It will be appreciated that the faucet designs described above are merely provided as examples and that numerous variations exist. Any housing design with a vertical split that enables two streams of water to be dispensed by pivoting two housing members relative to one another may be utilized. Additionally, the faucets may include various additional features, such as aerators, filtration devices (inline and/or via separate dispensers), soap dispensers, Internet-connected smart controls, and/or other features. For example, in some embodiments, the valve actuators 134 (or other components) may be able to selectively control whether water flowed to each housing member 106 is filtered or not. In other words, one of the housing members 106 and water hoses 114 may flow filtered water while the other housing member 106 and water hose 114 deliver unfiltered water, both may flow filtered water, or both may flow unfiltered water.

Figure 2:
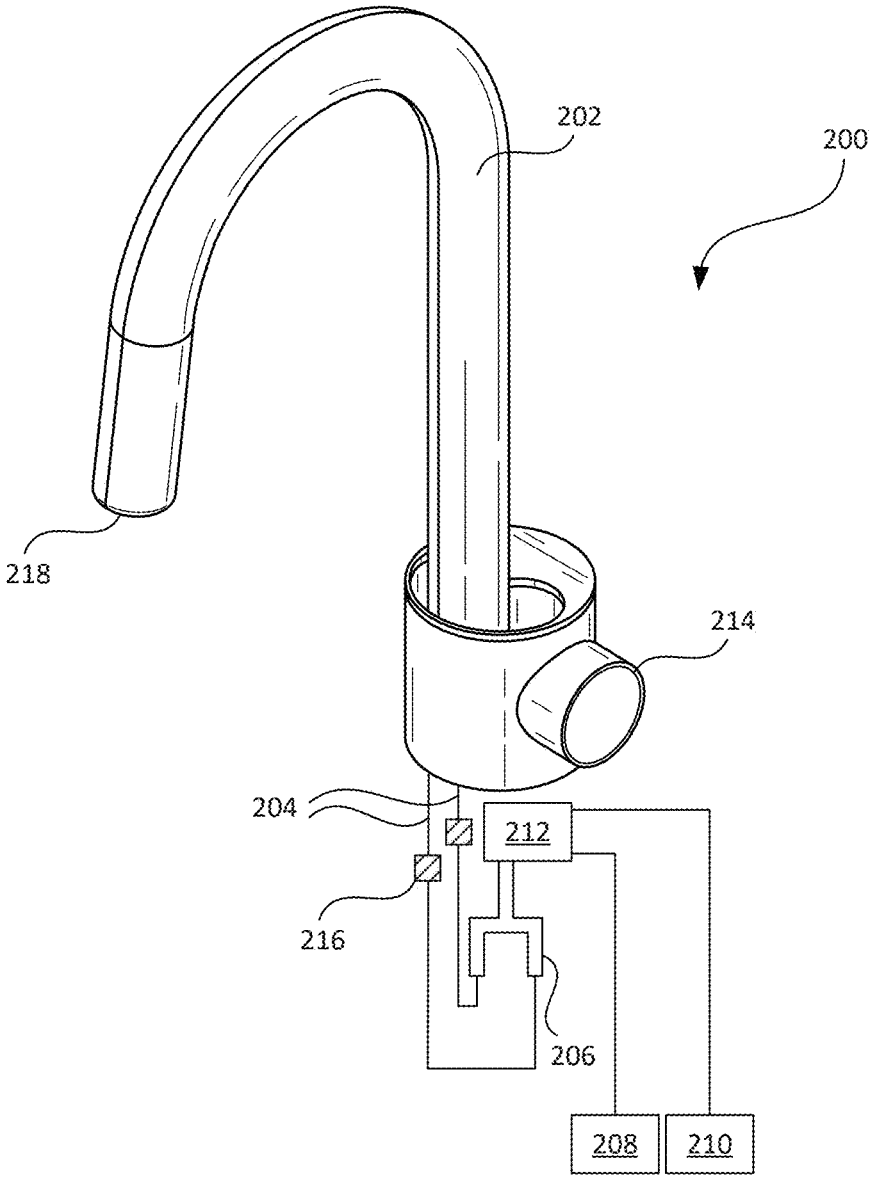
FIG. 2 shows a schematic system diagram of a faucet system according to some embodiments of the present technology.

FIG. 2 illustrates a system diagram of a faucet system 200 according to embodiments of the present technology. The faucet system 200 may include a faucet 202, which may be similar to faucet 100. For example, the faucet 202 may include two housing members that are pivotable relative to one another. Each housing member may receive a separate water hose 204, which may deliver water to an outlet of the respective housing member. Outlet ends of a Y-adaptor 206 may be coupled with an upstream end of each water hose 204. An inlet end of the Y-adapter 206 may be coupled with a hot water supply 208 and a cold water supply 210. A mixing valve 212 may be positioned upstream of the Y-adapter 206 and may be coupled with one or more valve actuators 214 of the faucet 202. While shown below the base of the faucet 202, it will be appreciated that the mixing valve 212 may be disposed within the base in some embodiments. The valve actuators 214 may control flow from each of the hot water supply 208 and the cold water supply 210 and may mix such flows prior to delivery to the faucet 200. This enables operation of the valve actuator(s) 214 to control a temperature and/or flow rate of the water that is dispensed from the faucet 202. In the illustrated embodiment, the faucet 202 includes a single valve actuator 214 (or set of valve actuators) that controls flow through each water hose 204 simultaneously. In other words, in both a joined position and a divided position, water dispensed from the faucet 202 via each water hose 204 will have the same flow characteristics (unless a nozzle actuator on a spray wand or other component is adjusted for one of the water hoses 204). In some embodiments, each water hose 204 may include one or more counterweights 216, which may be coupled downstream of the Y-adapter 206 and may help with retraction of the water hoses 204 and spray wands 218 as discussed above.

Figure 3:
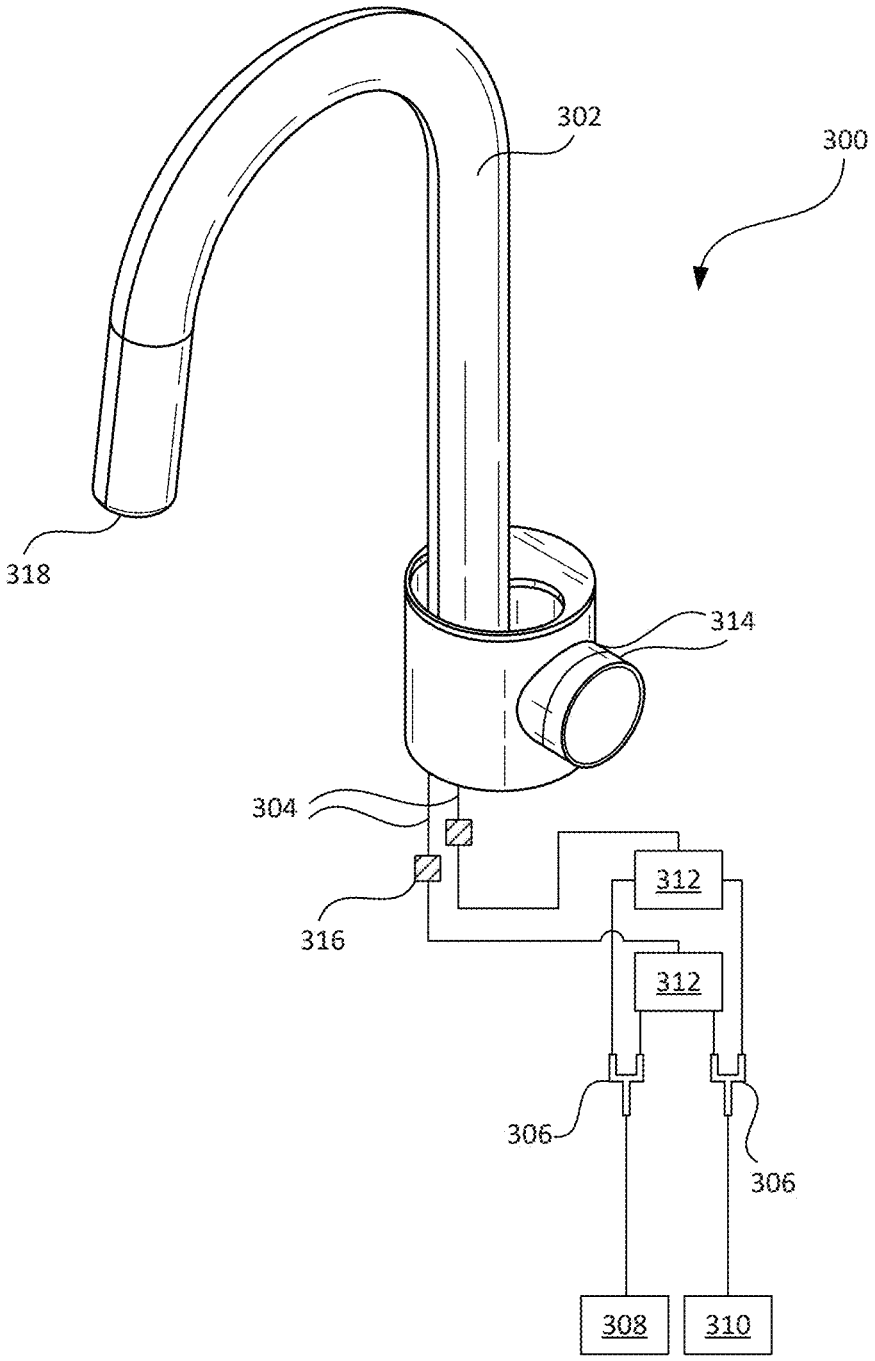
FIG. 3 shows a schematic system diagram of a faucet system according to some embodiments of the present technology.

In other embodiments, the flow through each water hose may be independently controlled. For example, FIG. 3 illustrates a system diagram of a faucet system 300 that enables independent flow control through each housing member according to embodiments of the present technology. The faucet system 300 may include a faucet 302, which may be similar to faucet 100. For example, the faucet 302 may include two housing members that are pivotable relative to one another. Each housing member may receive a separate water hose 304, which may deliver water to an outlet of the respective housing member. Water lines from a hot water supply 308 and a cold water supply 310 may each be coupled with an inlet end of dedicated Y-adapters 306. The Y-adapters 306 may split each of the hot and cold water lines into two components, which may be coupled with a number of mixing valves 312. For example, one hot water line and one cold water line may be fed into each of two mixing valves 312, which may be each coupled with one or more valve actuators 314 of the faucet 302. While shown below the base of the faucet 302, it will be appreciated that the mixing valves 312 may be disposed within the base in some embodiments. The valve actuators 314 may control flow from each of the hot water supply 308 and the cold water supply 310 and may mix such flows prior to delivery to each water hose 304. This enables operation of the valve actuator(s) 314 to control a temperature and/or flow rate of the water that is dispensed from each water hose 304 independently of one another. In the illustrated embodiment, the faucet 302 includes a single valve actuator 314 (or set of valve actuators) for each water hose 304, with each valve actuator controlling flow through each water hose 304 independently of one another. In other words, in a joined position and/or a divided position, water dispensed from the faucet 302 via each water hose 304 may have a same or different set of flow characteristics. In some embodiments, each water hose 304 may include one or more counterweights 316, which may be coupled downstream of the Y-adapter 306 and may help with retraction of the water hoses 304 and spray wands 318 as discussed above.

It will be appreciated that the faucet systems described above are merely provided as examples and that numerous variations exist. For example, simpler or more complex valve and/or plumbing arrangements may be utilized to control the flow characteristics of water dispensed by one or both housing members and/or spray wand portions. Additionally, different valve actuator arrangements may necessitate different plumbing arrangements. While shown with one or two valve actuators (or sets of valve actuators), it will be appreciated that a third valve actuator (or set of valve actuators) may be used to enable control of the flow characteristics of water through each hose independently or simultaneously may be used.

The methods, systems, and devices discussed above are examples. Some embodiments were described as processes depicted as flow diagrams or block diagrams. Although each may describe the operations as a sequential process, many of the operations can be performed in parallel or concurrently. In addition, the order of the operations may be rearranged. A process may have additional steps not included in the figure. It will be further appreciated that all testing methods described here may be based on the testing standards in use at the time of filing or those developed after filing.

It should be noted that the systems and devices discussed above are intended merely to be examples. It must be stressed that various embodiments may omit, substitute, or add various procedures or components as appropriate. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention.

Specific details are given in the description to provide a thorough understanding of the embodiments. However, it will be understood by one of ordinary skill in the art that the embodiments may be practiced without these specific details. For example, well-known structures and techniques have been shown without unnecessary detail in order to avoid obscuring the embodiments. This description provides example embodiments only, and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention.

Having described several embodiments, it will be recognized by those of skill in the art that various modifications, alternative constructions, and equivalents may be used without departing from the spirit of the invention. For example, the above elements may merely be a component of a larger system, wherein other rules may take precedence over or otherwise modify the application of the invention. Also, a number of steps may be undertaken before, during, or after the above elements are considered. Accordingly, the above description should not be taken as limiting the scope of the invention.

Also, the words "comprise", "comprising", "contains", "containing", "include", "including", and "includes", when used in this specification and in the following claims, are intended to specify the presence of stated features, integers, components, or steps, but they do not preclude the presence or addition of one or more other features, integers, components, steps, acts, or groups.

Unless defined otherwise, all technical and scientific terms used herein have the same meaning as commonly or conventionally understood. As used herein, the articles "a" and "an" refer to one or to more than one (i.e., to at least one) of the grammatical object of the article. By way of example, "an element" means one element or more than one element. "About" and/or "approximately" as used herein when referring to a measurable value such as an amount, a temporal duration, and the like, encompasses variations of ±20% or ±10%, ±5%, or ±0.1% from the specified value, as such variations are appropriate to in the context of the systems, devices, circuits, methods, and other implementations described herein. "Substantially" as used herein when referring to a measurable value such as an amount, a temporal duration, a physical attribute (such as frequency), and the like, also encompasses variations of ±20% or ±10%, ±5%, or ±0.1% from the specified value, as such variations are appropriate to in the context of the systems, devices, circuits, methods, and other implementations described herein.

As used herein, including in the claims, "and" as used in a list of items prefaced by "at least one of" or "one or more of" indicates that any combination of the listed items may be used. For example, a list of "at least one of A, B, and C" includes any of the combinations A or B or C or AB or AC or BC and/or ABC (i.e., A and B and C). Furthermore, to the extent more than one occurrence or use of the items A, B, or C is possible, multiple uses of A, B, and/or C may form part of the contemplated combinations. For example, a list of "at least one of A, B, and C" may also include AA, AAB, AAA, BB, etc.

What is claimed is:

1. A faucet, comprising:

a faucet housing comprising a first housing member and a second housing member, wherein:

the first housing member and the second housing member are pivotable relative to one another about a vertical axis between a joined position in which inner surfaces of the first housing member and the second housing member contact one another and a divided position in which the inner surfaces of the first housing member and the second housing member are spaced apart from one another;

the inner surfaces of the first housing member and the second housing member extend vertically along a length of each respective housing member;

the inner surfaces of the first housing member and the second housing member face one another in the joined position;

the first housing member defines a first water delivery conduit; and the second housing member defines a second water delivery conduit.

2. The faucet of claim 1, further comprising:

a first water hose disposed within the first water delivery conduit; and a second water hose disposed within the second water delivery conduit.

3. The faucet of claim 2, further comprising:

a spray wand that is movably coupled with the faucet housing, the spray wand comprising a first spray wand portion that is coupled with the first water hose and a second spray wand portion that is coupled with the second water hose, wherein the first spray wand portion and the second spray wand portion are separable from one another.

4. The faucet of claim 2, further comprising:

a mixing valve that is configured to couple each of the first water hose and the second water hose with a hot water supply and a cold water supply.

5. The faucet of claim 2, further comprising:

a plurality of mixing valves that are configured to independently couple the first water hose and the second water hose with a hot water supply and a cold water supply.

6. The faucet of claim 1, further comprising:

one or more releasable coupling mechanisms that are configured to secure the first housing member and the second housing member in the joined position.

7. The faucet of claim 6, wherein:

the one or more releasable coupling mechanisms comprises one or both of a magnet and a clasp.

8. The faucet of claim 1, further comprising:

a base that defines an aperture through a thickness of the base, wherein the aperture is sized and shaped to receive lower ends of the first housing member and the second housing member while permitting the first housing member to pivot relative to the second housing member.

9. The faucet of claim 8, wherein:

the base comprises a sealing member that seals regions of the aperture not occupied by the first housing member and the second housing member while permitting the first housing member to pivot relative to the second housing member.

10. The faucet of claim 1, wherein:

in the joined position, a width of a seam between the first housing member and the second housing member is less than 0.5 mm.

11. The faucet of claim 1, wherein:

a total travel range between the joined position and a fully divided position is at least 120 degrees.

12. A faucet, comprising:

a faucet housing comprising a first housing member and a second housing member, wherein:

the first housing member and the second housing member are pivotable relative to one another about a vertical axis between a joined position in which inner surfaces of the first housing member and the second housing member contact one another and a divided position in which the inner surfaces of the first housing member and the second housing member are spaced apart from one another;

the first housing member defines a first water delivery conduit; and the second housing member defines a second water delivery conduit;

a first water hose disposed within the first water delivery conduit;

a second water hose disposed within the second water delivery conduit; and a base that defines an aperture through a thickness of the base, wherein the aperture is sized and shaped to receive lower ends of the first housing member and the second housing member while permitting the first housing member to pivot relative to the second housing member.

13. The faucet of claim 12, further comprising:

one or more valve actuators that are configured to control one or both of a flow rate and a temperature of water to the first water hose and the second water hose.

14. The faucet of claim 12, further comprising:

a first plurality of magnets spaced along a length of the first housing member; and a second plurality of magnets spaced along a length of the second housing member, wherein:

the first plurality of magnets are aligned with the second plurality of magnets and are arranged to attract the second plurality of magnets when the first housing member and the second housing member are proximate one another.

15. The faucet of claim 12, wherein:

when in the joined position, there is no visible seam between the first housing member and the second housing member.

16. The faucet of claim 12, further comprising:

a spray wand that is movably coupled with the faucet housing, the spray wand comprising a first spray wand portion that is coupled with the first water hose and a second spray wand portion that is coupled with the second water hose, wherein:

the first spray wand portion and the second spray wand portion are separable from one another;

the first spray wand portion comprises a first plurality of magnets;

the second spray wand portion comprises a second plurality of magnets; and the first plurality of magnets are aligned with the second plurality of magnets and are arranged to attract the second plurality of magnets when the first spray wand portion and the second spray wand portion are proximate one another.

17. The faucet of claim 12, further comprising:

a spray wand that is movably coupled with the faucet housing, wherein:

the spray wand comprises a first plurality of magnets;

a distal end of the faucet housing comprises a second plurality of magnets; and the first plurality of magnets are aligned with the second plurality of magnets and are arranged to attract the second plurality of magnets when the spray wand and the distal end of the faucet housing are proximate one another.

18. The faucet of claim 12, wherein:

when in the joined position, the first water hose and the second water hose deliver a single stream of water.

19. The faucet of claim 12, wherein:

each of the first housing member and the second housing member forms an elongate tube.

20. The faucet of claim 12, wherein:

each of the first water hose and the second water hose is independently controllable.

* * * * *